US005642948A

United States Patent [19]

Harris et al.

[11] Patent Number: 5,642,948

[45] Date of Patent: Jul. 1, 1997

[54] BIAXIAL PRINTER FOR PORTRAIT AND LANDSCAPE PRINTING

[75] Inventors: Richard Hunter Harris, Raleigh; Michael John Kinney, Cary; Kevin Hunter Vorhees, Raleigh, all of N.C.

[73] Assignee: International Business Machines Corporation, Armonk, N.Y.

[21] Appl. No.: 630,803

[22] Filed: Apr. 10, 1996

Related U.S. Application Data

[63] Continuation of Ser. No. 444,474, May 19, 1995, Pat. No. 5,533,817.

[51] Int. Cl.[6] ..... B41J 2/255

[52] U.S. Cl. ..... 400/124.28; 400/279; 395/108

[58] Field of Search ..... 400/605, 708, 400/279, 582, 17, 65, 124.28; 364/404, 405; 395/108, 109, 110

[56] References Cited

U.S. PATENT DOCUMENTS

| | | | |
|---|---|---|---|
| 4,408,907 | 10/1983 | Bernardis | 101/93.05 |
| 5,437,004 | 7/1995 | Miyasaka et al. | 395/113 |
| 5,533,817 | 7/1996 | Harris et al. | 400/605 |

FOREIGN PATENT DOCUMENTS

| | | | |
|---|---|---|---|
| 120467 | 7/1984 | Japan | 400/124.28 |
| 41559 | 2/1986 | Japan | 400/124.28 |

*Primary Examiner*—Edgar S. Burr
*Assistant Examiner*—Steven S. Kelley
*Attorney, Agent, or Firm*—Kelly K. Kordzik; John D. Flynn

[57] ABSTRACT

A printer employs a print head having a wire column arranged at an angle between 0° and 90° relative to a permitted line of motion of the print head. This angled print head allows for both portrait and landscape printing. Portrait mode printing is performed by controlling movement of the angled print head along the permitted line of motion during printing of each line of images. Landscape mode printing is controlled by maintaining a stationary position of the print head while the print receivable medium is moved in a direction perpendicular to the permitted line of motion of the print head.

7 Claims, 4 Drawing Sheets

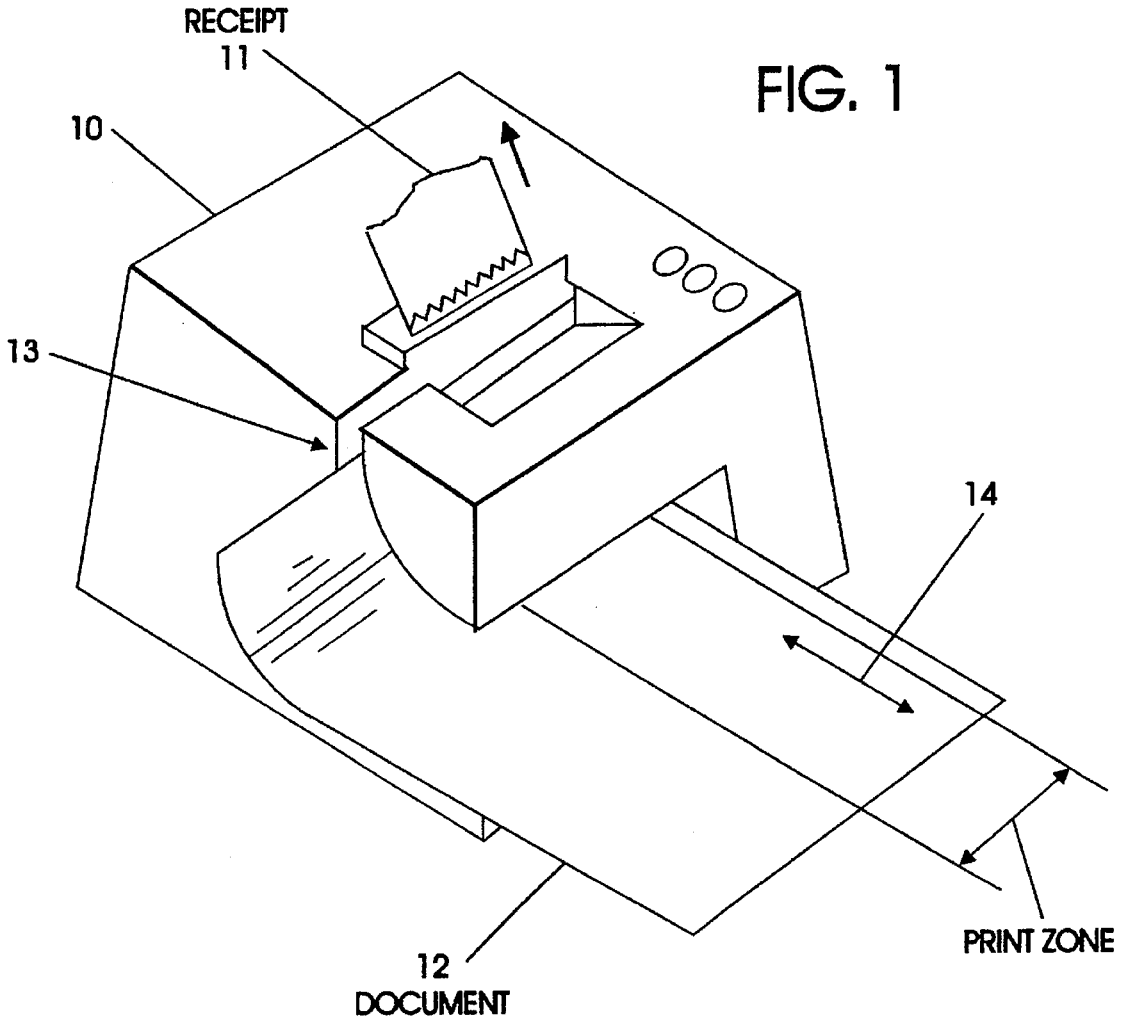
FIG. 1
FIG. 5
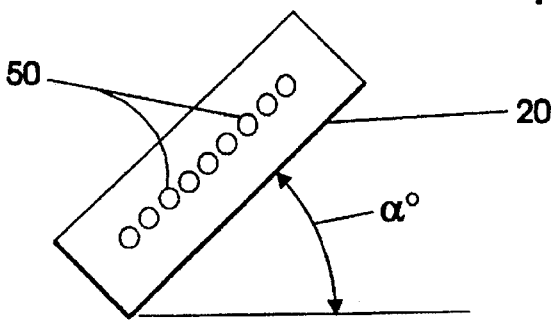

BIAXIAL PRINTER FOR PORTRAIT AND LANDSCAPE PRINTING

This is a continuation of application Serial No.08/444,474 filed on May 19, 1995 now U.S. Pat. No. 5,533,817.

TECHNICAL FIELD OF THE INVENTION

The present invention relates in general to printers, and in particularly, to a printer utilizing an angled print head allowing for printing in both portrait and landscape modes.

BACKGROUND OF THE INVENTION

Point of Sale ("POS") printers are often utilized to print receipts as a result of a cash or credit card sale at a business. Such receipts are generally two to three and one-half inches in width providing for approximately 70–80 millimeters, or 40 characters, of available space for printing a line in portrait mode. The receipt may be produced from a roll of paper or fast fold papers. Portrait mode is a vertical print orientation in which a document is printed across the narrower dimension of the paper.

One concern regarding such POS printers is the footprint (i.e., the surface area occupied by a personal computer or peripheral device) of the printer, since counter space is typically at a premium at a cash register site. Thus, it is desirable that the footprint of a POS printer be as small as possible. Generally, this concern is satisfied because of the small size of the receipt primed from the POS printer. However, there is also often a desire to print on larger width documents, such as checks. To print on a check, a larger POS printer would be required.

To solve this problem, printing of a check may be done in landscape mode. Landscape mode is a horizontal print orientation in which text or images are printed "sideways." In contrast to portrait mode, landscape mode prints across the wider dimension of a rectangular sheet of paper. Traditionally, landscape mode printing is quite slow. For instance, the IBM Model 2 printer prints the front of checks (3 lines of print) in approximately 13 seconds by feeding the check through the document feed station and printing a rotated font. However, 13 seconds may be considered to be too long of a period of time to wait for the printing of the information on the check. The desire to check out as many customers as possible in a short period of time limits the mount of time for such landscape mode priming.

Furthermore, because of the limited counter space, it is not desirable to (1) replace the POS printer with a printer having a larger footprint and an ability to print in portrait mode on larger documents; or (2) install a second larger printer in addition to the POS printer for the receipts.

Thus, there is a need in the art for a printer that is capable of printing unit records in both portrait and landscape modes, wherein the printing of each unit record is performed in a relatively short time.

SUMMARY OF THE INVENTION

The foregoing need is satisfied by the present invention, which utilizes a print head (the part of a printer that mechanically controls the imprinting of characters on paper) slanted at an angle between 0 and 90 degrees so that the print head is capable of printing the same size characters in both landscape and portrait modes, but yet still maintains a minimal footprint. Any other angle print head is acceptable, but would yield different size characters for portrait mode relative to landscape mode.

When printing on paper in portrait mode, the print head is moved horizontally for printing each line. When printing in landscape, the print head is stopped at the correct position. The printer then moves the document and fires the print head wires to produce a landscape line of print. The printer moves the prim head to the next line. The printer feeds the document in the opposite direction while printing the next line.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWING

For a more complete understanding of the present invention, and the advantages thereof, reference is now made to the following descriptions taken in conjunction with the accompanying drawings, in which:

FIG. 1 illustrates a perspective view of a printer in accordance with the present invention;

FIG. 5 illustrates the end of the print head slanted at an angle; and

DETAILED DESCRIPTION OF A PREFERRED EMBODIMENT OF THE INVENTION

Figure 2:
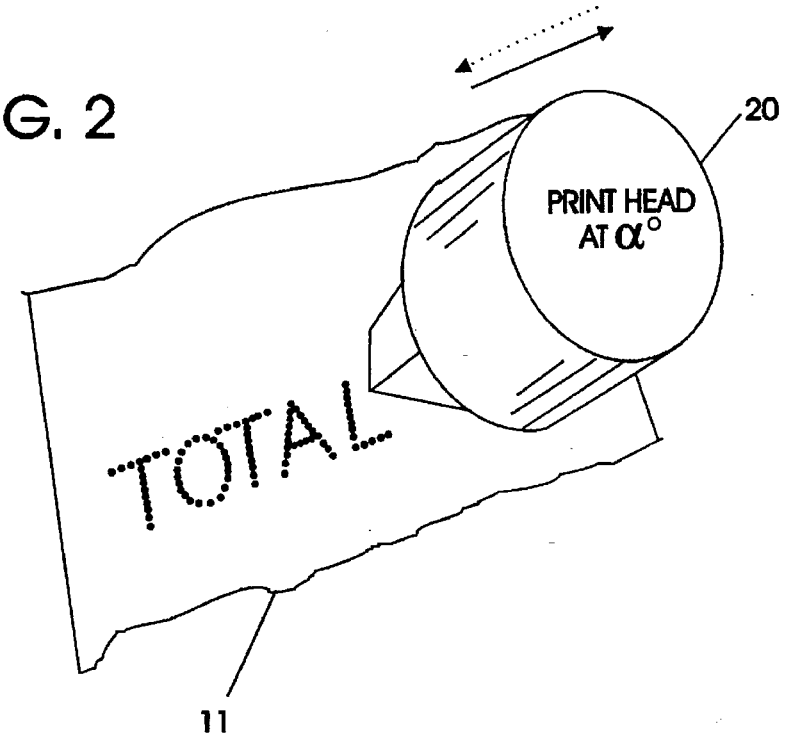
FIG. 2 illustrates a print head in accordance with the present invention printing in portrait mode.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

Referring to FIG. 1, there is illustrated printer 10, having the capability of a standard single station printer having a capability of printing in portrait mode on a paper strip having a width of between x and y millimeters (hereinafter referred to as a "receipt ") or printing in landscape mode on a discrete medium having a width of between a and b millimeters and a length greater than b millimeters (hereinafter referred to as "document 12"). Printer 10 has a separate bidirectional document feed as indicated by double-headed arrow 14 on document 12, and unidirectional (or bidirectional) receipt feed for receipt 11. Printing is performed on receipt 11 until document 12 is inserted into document slot 13. The system as discussed below with respect to FIG. 4 controls printer 10 to either print in portrait or landscape mode.

Printer 10 may be a POS printer located in proximity to a computerized "cash register" for printing receipts of sales as inputted into the cash register, or for printing documents such as checks or information on checks, such as illustrated in FIG. 1 by the insertion of document 12 into document slot 13.

Referring next to FIG. 2, there is illustrated print head 20, which is utilized within printer 10. FIG. 2 merely illustrates print head 20 printing in portrait mode on receipt 11, without illustrating the remainder of printer 10 (for simplicity). In portrait mode, print head 20 traverses laterally, or horizontally, across receipt 11 to print a horizontal line. Once one line is printed, receipt 11 will be advanced upwards one line so that print head 20 may print the next line in portrait mode.

Figure 3:
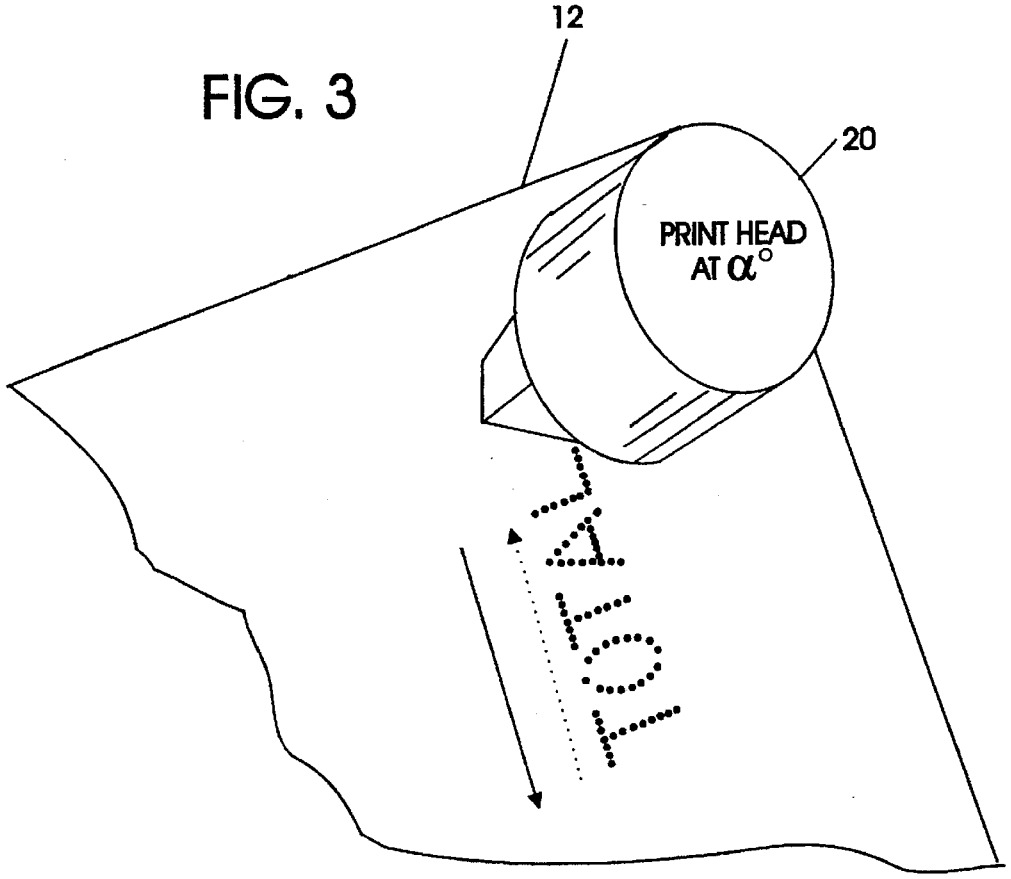
FIG. 3 illustrates the print head in accordance with the present invention printing in landscape mode.

In FIG. 3, there is also illustrated print head 20 without the remainder of printer 10. In this illustration, printer 10 is printing in landscape mode, whereby document 12, which has been inserted into document slot 13 is traversed "up and down" beneath print head 20, which is kept in a stationary position to produce a vertical print line.

Once print head 20 has printed one line, it may be positioned laterally or sideways one line so that print head 20 may then print the next line in landscape mode.

As shown in FIGS. 2 and 3, both portrait and landscape mode printing can be performed by print head 20, since print head 20 is slanted at an angle, i.e., the print wire column as illustrated in FIG. 5 is slanted at an angle $\propto$ so that printing may be performed both vertically and horizontally. If angle$\propto$ is 45° , then the portrait and landscape modes will print the same size font. When portrait or horizontal lines are to be printed, as illustrated in FIG. 2, print head 20 traverses left and right and receipt 11 is kept stationary for each print line. Print wire timings are controlled so that the print wire column 50 produces the desired characters. Receipt 11 is advanced after a line is printed.

When landscape or vertical lines are printed, as illustrated in FIG. 3, the print head remains stationary and document 12 is traversed vertically up and down. Print head 20 is moved to the next line and the process is repeated. Timings are controlled to print head 20 so column 50 at angle $\propto$ produces the desired characters in the landscape mode.

The print head 20 as rotated $\propto$ degrees will print smaller characters than a typical vertical print head. A special character font could be implemented to increase the character size. Typically, 7 to 9 print wires can be used to print most characters.

A unique print head design could be designed to be more robust. The wires 50 could be larger in diameter and/or the wire guide could have more material around the wire.

Figure 4:
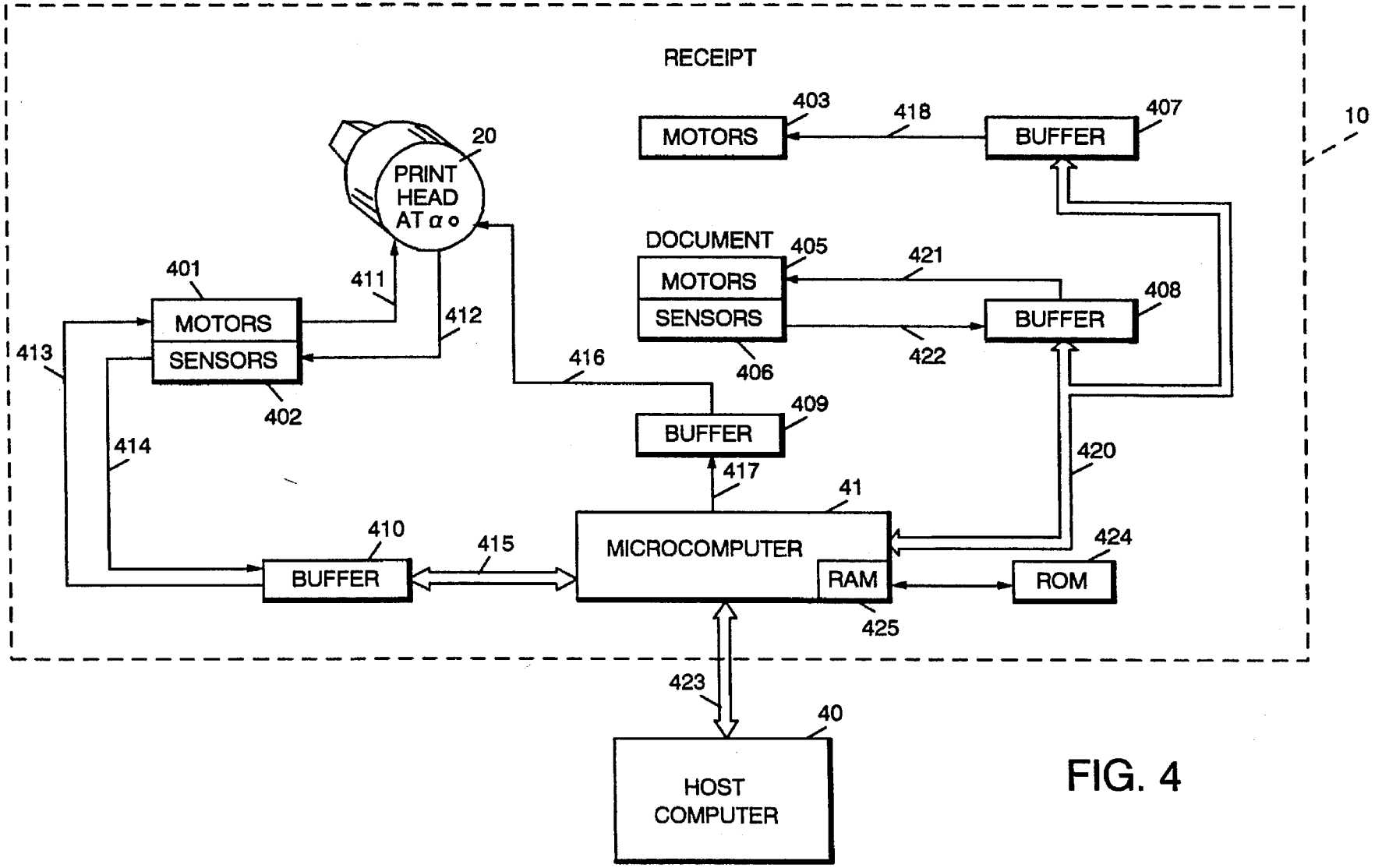
FIG. 4 illustrates a block diagram of the printer controller in accordance with the present invention.

Referring next to FIG. 4, there is illustrated a block diagram of printer 10 coupled through serial or parallel bus 423 to host computer 40. Host computer 40 may be a POS computer, such as a cash register. Printer 10 includes microcomputer 41 (e.g., a Motorola 68HC16 microcomputer), which includes a microprocessor and possibly random access memory 425 and which may be coupled to programmable read only memory 424. There are several input/output ports for coupling to buses 415, 417 and 420. Bus 415 is coupled to buffer means 410, which translates signal levels received from sensors 402 for return to microcomputer 41, and also translates a signal level to a sufficient voltage and current level to appropriately drive motor 401 through line 413. The functions of buffers 407 and 408 are similar to the functions of buffer 410.

Printer 10 also includes print head 20, which has its wire column 50 located at an angle as illustrated in FIGS. 2 and 3 (for example 45° ). The horizontal positioning of print head 20 with respect to receipt 11 or document 12 is performed by motor 401. A typical rail, carriage, and belt (not shown) may be used to position print head 20 horizontally. The horizontal position of print head 20 is sensed by sensors 402 through line 412.

Dot patterns for characters to be printed by print head 20, whether in portrait or landscape mode, are produced by microcomputer 41 based on character codes received from host computer 40. These signals are then given sufficient levels by buffer 409 when received through bus 417, and are then transmitted to print head 20 by bus 416 for printing by print head 20.

Motor 403 operates to vertically advance receipt 11 in a typical manner known in the art.

When document 12 is inserted into document slot 13, sensors 406 sense the insertion of document 12 and inform microcomputer 41 of such an event. Sensors 406 also monitor the relative position of document 12 with respect to print head 20. The up and down vertical movement of document 12 is performed by motor 405 in a well-known manner.

Microcomputer 41 receives inputs from sensors 402 and 406, and manipulates motors 401, 403, and 405. The relative control of these motors and sensors, along with the control of the printing of characters by print head 20 are all performed by microcomputer 41 in a well-known manner.

As an example, host computer 40 may have received particular inputs and then desires to print a receipt 11 or to print information on document 11. Host computer 40 may send a series of ASCII codes that represent characters, punctuation marks, and printer movements, such as tabs, carriage returns, and form feeds, which control the positioning of print head 20 in relation to either receipt 11 or document 12.

The ASCII codes are stored in a buffer, which may be a special section of printer 10's random access memory 425. Because it usually takes longer for a dot-matrix printer to print characters than it takes host computer 40 and software to send those characters to printer 10, the buffer helps free up host computer 40 to perform other functions during printing. The buffer within microcomputer 41 may send a control code to host computer 40 to tell it to suspend its stream of data. When the buffer frees up space by printing some of the characters, printer 10 will then send a code to host computer 40, which resumes sending data.

Among those codes may be typical commands that tell printer 10 to use a certain font's bit map table, which may be contained in ROM 424. That table tells printer 10 the pattern of dots that it should use to create the characters used by the ASCII codes.

Thereafter, microcomputer 41 takes the information provided by the bit map table for an entire line of type and calculates the most efficient path for print head 20 to travel. For example, some lines may actually be printed from right to left. Microcomputer 41 sends signals via buses 416 and 417 and buffer 409 to fire pins 50 in print head 20, and it also controls movements of print head 20 and receipt 11 or document 12, as discussed above. These electrical signals from microcomputer 41 are amplified by buffer 409 and travel to certain other circuits that lead to print head 20. Print head 20 may contain any number of wires, called printing pins, that are aligned in the 45° angle as discussed above. One end of each of pins 50 is matched to an individual electromagnet actuator. The signal from microcomputer 41 activates a coil that creates a magnetic field that propels an armature at the end of the pin causing the pin to move toward the paper, thus printing the portion of the character.

Please note that print head 20 may be a dot-matrix impact-type printer as discussed above, or may be a portion of a typical ink-jet printer wherein the ink:jet nozzles are aligned at an angle. The present invention is operable with any dot matrix printing method.

Figure 6:
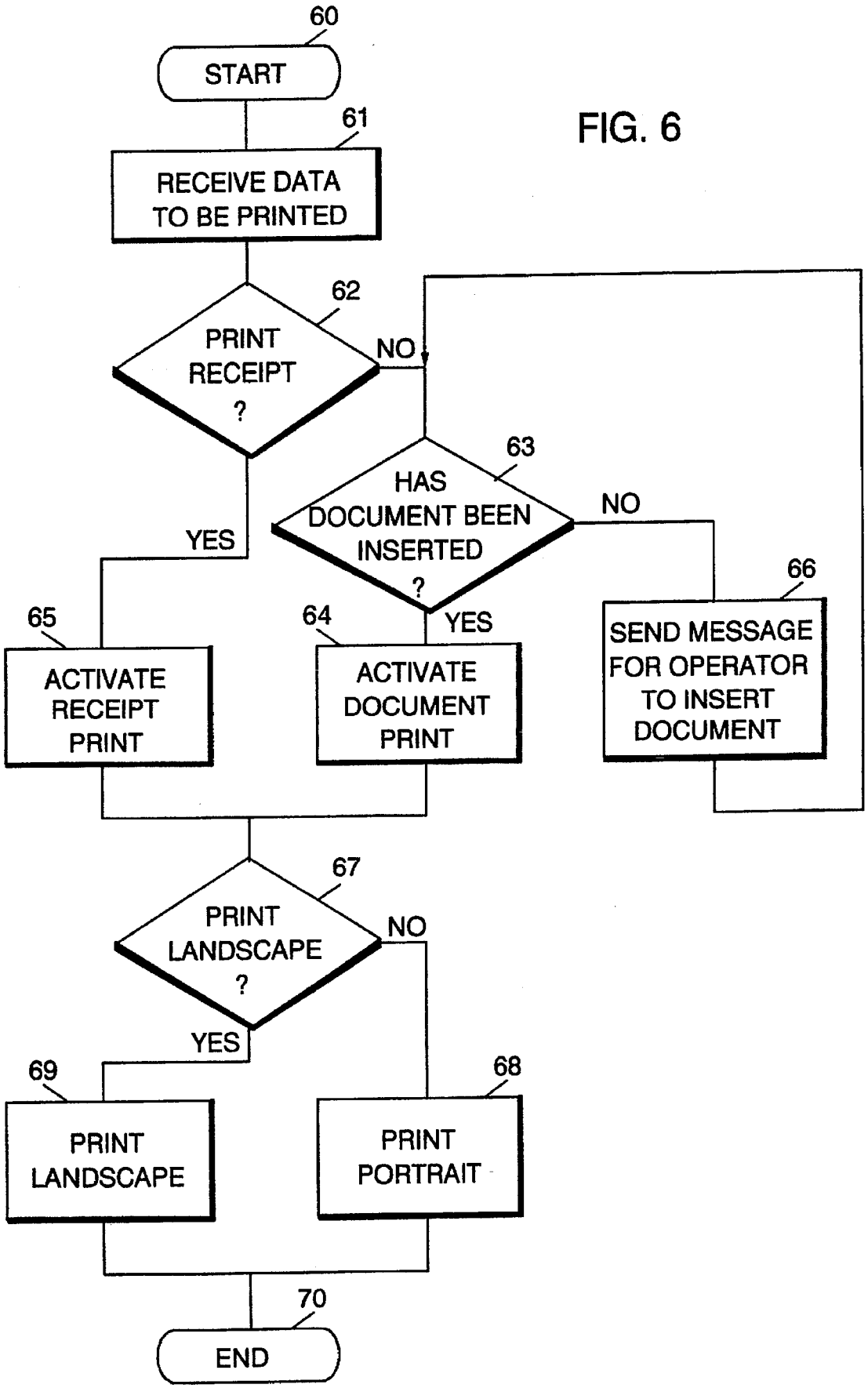
FIG. 6 illustrates a flow diagram in accordance with the present invention.

Referring next to FIG. 6, there is illustrated a flow diagram of the operation of the print controller, which may be implemented within microcomputer 41. The flow starts at step 60 and proceeds to step 61 where data to be printed is received from RAM 425. Step 62 determines whether a receipt 11 or document 12 is to be printed by inspection of the print data. Document printing requires that a document 12 is present. If the data does not indicate that a receipt 11 is to be printed, a document 12 is anticipated and document sensors 406 are used to determine that a document 12 has been inserted, step 63. If no document 12 has been inserted the printer 10 signals the system to display a message to the operator to "Insert document", step 66. If a document 12 has been inserted, then step 64 activates the document print station, which moves the document 12 to the print location specified in the print data. If step 62 determines that a receipt 11 is to be printed, then the receipt print station is activated.

Step 67 inspects the print data to determine whether to print in landscape mode or portrait mode. If landscape mode is to be printed, step 69 moves the print head 20 to the specified location and the document 12 is fed up or down beneath the stationary print head 20 until the line is printed. Printing stops at step 70 until another line of print is requested which initiates the process again at step 60. If landscape mode is not to be printed from step 67, then step 68 prints portrait mode on the specified document 12 or receipt 11. The print head 20 moves horizontally across the print field while the document 12 or receipt 11 remains stationary. Printing stops at step 70 until another line of print is requested which initiates the process against at step 60.

Although the present invention and its advantages have been described in detail, it should be understood that various changes, substitutions and alterations can be made herein without departing from the spirit and scope of the invention as defined by the appended claims. For instance, the present embodiment shows all documents 12 being printed in landscape mode. Bidirectional receipt feeding may be used to allow both portrait and landscape printing on receipt 11, and conversely, both landscape and portrait printing may be done on document 12.

What is claimed is:

1. A printer comprising:

a print head having a column of printing elements arranged at an angle relative to a direction of travel of said print head;

means operable for positioning a print receivable medium in a direction normal to said direction of travel of said print head;

means operable for performing portrait mode printing by said print head on said print receivable medium by moving said print head in said direction of travel in order to print characters on said print receivable medium in said portrait mode; and means operable for performing landscape mode printing by said print head on said print receivable medium by moving said print receivable medium in said direction normal to said direction of travel of said print head while said print head remains stationary in order to print characters on said print receivable medium in said landscape mode, wherein said angle of printing elements is such that printing in portrait mode is in a larger font size than printing in landscape mode.

2. The printer as recited in claim 1, wherein said angle of printing elements is maintained for both said portrait mode and said landscape mode printing.

3. The printer as recited in claim 1, wherein said print head is an impact-type print head.

4. The printer as recited in claim 1, wherein said print head is an ink-jet print head.

5. The printer as recited in claim 1 wherein said print head is a thermal dot matrix print head.

6. The printer as recited in claim 1, wherein said angle is between 0 and 90 degrees.

7. A printer comprising:

a print head having a column of printing elements arranged at an angle relative to a direction of travel of said print head;

means operable for positioning a print receivable medium in a direction normal to said direction of travel of said print head;

means operable for performing portrait mode printing by said print head on said print receivable medium by moving said print head in said direction of travel in order to print characters on said print receivable medium in said portrait mode; and means operable for performing landscape mode printing by said print head on said print receivable medium by moving said print receivable medium in said direction normal to said direction of travel of said print head while said print head remains stationary in order to print characters on said print receivable medium in said landscape mode, wherein said angle of printing elements is such that printing in portrait mode is in a smaller font size than printing in landscape mode.

* * * * *